US005116198A

United States Patent [19]

Vesala et al.

[11] Patent Number: 5,116,198

[45] Date of Patent: May 26, 1992

[54] CENTRIFUGAL PUMPING APPARATUS

[75] Inventors: Reijo Vesala, Kotka; Vesa Vikman, Kymi, both of Finland

[73] Assignee: A. Ahlstrom Corporation, Noormarkku, Finland

[21] Appl. No.: 579,406

[22] Filed: Sep. 7, 1990

[51] Int. Cl.[5] ..... F01D 25/32

[52] U.S. Cl. ..... 415/169.1; 415/143

[58] Field of Search ..... 415/169.1, 143

[56] References Cited

U.S. PATENT DOCUMENTS 4,256,436 3/1981 Fandrey et al. ..... 415/143
4,637,779 1/1987 Sherman et al. ..... 415/143
4,776,758 10/1988 Gullichsen ..... 415/169.1
4,826,398 5/1989 Gullichsen ..... 415/143
4,877,368 10/1989 Timperi et al. ..... 415/143
4,921,400 5/1990 Niskanen ..... 415/169.1

*Primary Examiner*—John T. Kwon
*Attorney, Agent, or Firm*—Cohen, Pontani, Lieberman & Pavane

[57] ABSTRACT

A centrifugal pump for pumping gas containing fiber suspensions includes a centrifugal pumping chamber (54); a centrifugal impeller (60) rotatably mounted within the pumping chamber (54); a liquid ring vacuum pump with a vacuum pump chamber (76) adjacent the centrifugal pumping chamber which includes a radially vaned vacuum pump rotor (96) mounted for rotation therein; an intermediate wall (72) separating the centrifugal pumping chamber from the liquid ring vacuum pump; and a gas inlet (94) and gas outlet (80) within the intermediate wall on the same side of the liquid-ring pump.

14 Claims, 1 Drawing Sheet

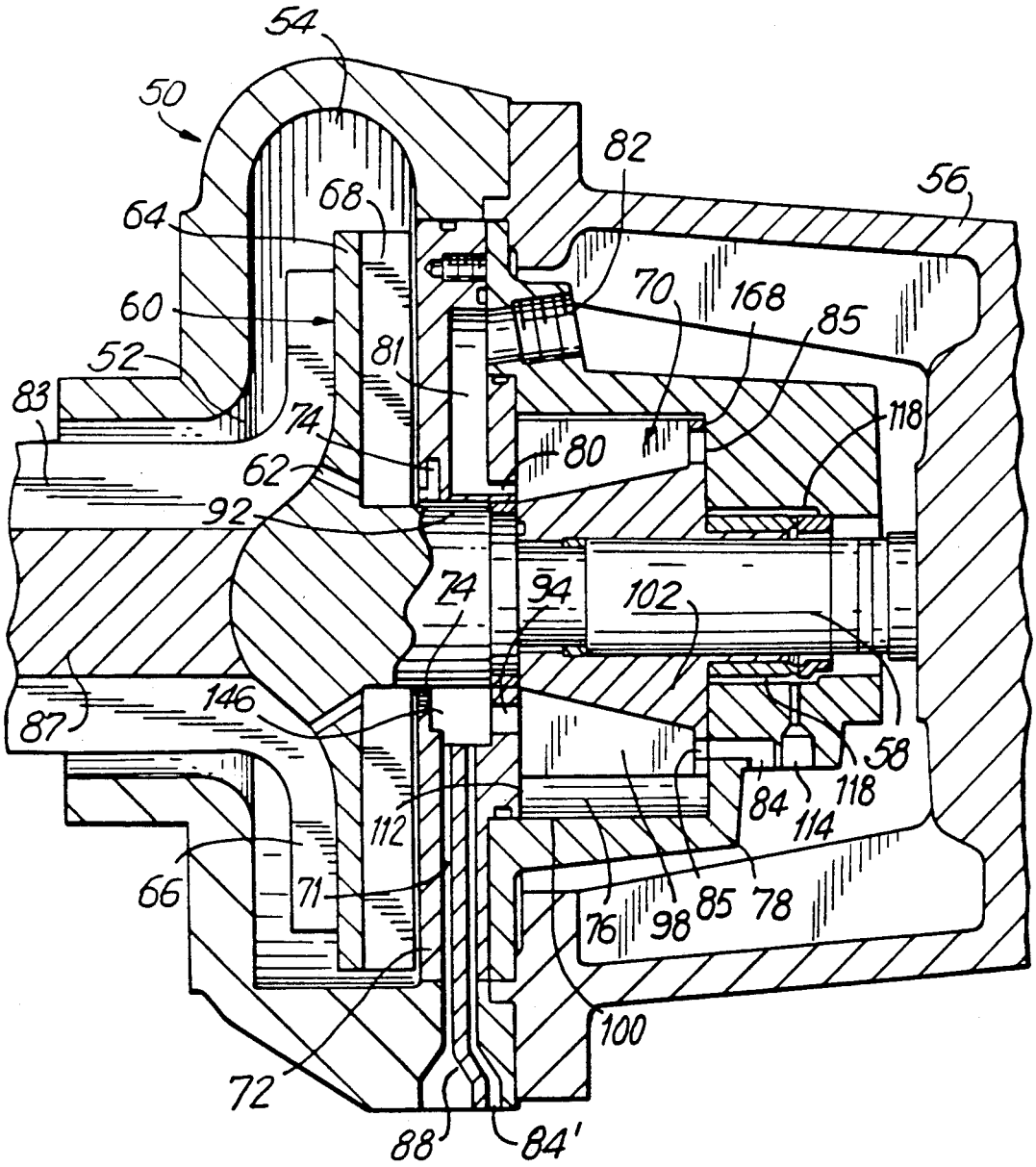
54
50
82
56
68
64
70
168
85
60
81
52
83
74
118
80
62
92
74
94
102
87
146
58
118
84
114
112
66
71
76
98
85
78
100
72
88
84'

CENTRIFUGAL PUMPING APPARATUS

FIELD OF THE INVENTION

The present invention relates to a centrifugal pumping apparatus having a built-in vacuum pump for the pumping of a gas containing fiber suspension and, specifically, to a pumping apparatus having an intermediate wall containing both gas inlet ports and gas discharge ports therein.

BACKGROUND AND SUMMARY OF THE INVENTION

Commercial devices which effectively handle suspensions, such as paper pulp, at medium consistency, that is at about 6–15% solids consistency, are known. It is also known that air or, more generally gas, if present in the fiber suspensions causes problems in almost all process stages in the pulp and paper industry. When pulp is pumped, mixed, screened, washed or otherwise handled without excess gas significant savings in equipment, power consumption and the like can be achieved. For instance, one device which has been particularly successful in allowing handling of gas-containing medium consistency fiber suspensions is a fluidizing centrifugal pump which simultaneously pumps and degasses the suspension. Typically, such pumps utilize a separate vacuum pump, piping from the centrifugal pump to the vacuum pump, a separate motor and motor mount for the vacuum pump, etc., in order to exhaust the gas which has been separated from the suspension so that the suspension may be effectively pumped by the pump impeller.

U.S. Pat. No. 3,230,890 discloses a centrifugal pump for removing gas from low consistency suspensions or from water having either a built-in vacuum pump or an external vacuum pump.

A fluidizing centrifugal pump having a built-in vacuum pump is disclosed in U.S. Pat. No. 4,776,758. The vacuum pump is a so-called liquid ring pump which has been arranged on the same shaft as the impeller behind an intermediate plate separating the centrifugal pump chamber from the vacuum pump chamber. A narrow ring-shaped duct serving as the gas inlet to the vacuum pump is arranged in the intermediate plate. The gas outlet, however, is provided in the back of the vacuum pump housing which contains the vaned rotor with a cylindrical central portion mounted for rotation between the front and back wall within the vacuum pump chamber.

Various problems have, however, been encountered with the pump in operation today. For example, the air removal capacity has been significantly lower than required, i.e. the vacuum created has not reached a sufficiently high level. Also, the discharge pressure of the vacuum pump has been found to be too low. In some cases, the material discharged from the vacuum pump, a mixture containing mainly gas but also some fibers, has been introduced into the top portion of a mass tower to recover the fibers. If, however, the discharge pressure of the vacuum pump is too low the pumped material cannot be conveyed to the top of the mass tower, and an additional pump must be installed for that purpose. Also, the open annular volume in the intermediate plate of prior art pump has a tendency to become clogged by the fibers.

In the prior art pump the axial gap between the vanes of the vacuum pump and the axially adjacent walls of the vacuum pump housing are not adjustable but are positioned at a distance or clearance of about 0.4 mm. The reasons for such relatively large clearance is the fact that there are a number of factors which render it is impossible to further decrease the clearance as the various components of the pump are installed on the shaft or around the shaft starting from the drive end of the shaft. Thus, the dimensions of the components effect the clearance. The result of too wide a clearance is, of course, an insufficient vacuum. Another reason for the wide clearance may also be the fact that the shaft of the pump tends to flex somewhat during operation creating the risk of mechanical contact between the vacuum pump vanes and the housing walls. Thus,, the large clearance has been provided intentionally to ensure long lasting operation of the pump.

The pump in accordance with the present invention is designed to eliminate most or all of the above problems. Accordingly the pump of the present invention is provided with an intermediate plate separating the centrifugal pump housing from the vacuum pump which is, preferably, a liquid-ring pump. Within this intermediate plate a gas discharge duct is provided which permits exhaustion of air from the vacuum pump. The air which is collected in front of the impeller will initially travel through one or more openings provided in the impeller backplate towards the back of the impeller and from there through an opening and non-annular volume which are also located within the intermediate plate to the suction side of the vacuum pump. As the rotor continues to rotate, the gas present between the vanes of the rotor is compressed by the liquid ring and is expelled through the discharge port located also within the intermediate plate.

Preferably, the rotor central portion has a linearly varying diameter so that it is preferably conically tapered from the back wall of the pump toward the gas inlet and gas discharge port for preventing the build-up of air pockets around the rotor central portion. The vacuum pump rotor may also be provided with a radial extension forming a rotor shroud at the side opposite the air inlet and air discharge openings and which has preferably the same height as the rotor vanes. The shroud may be provided with a plurality of openings for the entry of make-up air for the control of the vacuum pump which is further explained below. The make-up air may, however, be introduced into the vacuum pump from the opposite side of the vacuum pump, i.e. from the side of the gas inlet and gas discharge ports so that, in this case, the rotor shroud may be entirely solid without openings therethrough.

The pump of the present invention may also be provided with means for introducing a liquid into the pump, and especially into the non-annular volume in the intermediate plate and air flow ducts of the pump for flushing these critical locations with a liquid such as flushing water and freeing the pump from fibers which otherwise tend to block the flow path of the pump. The flushing ducts may also be used to supply working liquid to the liquid ring of the vacuum pump.

The pump of the present invention also provides means for adjusting the relative axial position of the vacuum pump rotor relative to the front and rear wall of the vacuum pump chamber thereby providing significantly smaller operational of clearances therebetween. This may be achieved by either adjusting the axial position of the rotor with respect to the shaft, for example, by the addition of preferably annular shims between respective shoulders of the vacuum pump rotor and shaft. The relative axial position of the vacuum pump rotor with respect to the vacuum pump chamber may also be optimized by adjusting the axial position of the shaft with respect to the vacuum pump chamber and the centrifugal pump body, in which case the vacuum pump rotor is fixedly attached to the shaft. Finally, the relative axial position of the vacuum pump rotor and the vacuum pump chamber is optimized by adjusting the vacuum pump chamber with respect to the rotor and the centrifugal pump body.

In addition, a port for the admission of make-up air for the control of the vacuum pump may be provided at the rear wall of the vacuum pump. By rear wall of the vacuum pump is meant that wall which is located opposite the air inlet port remote from the intermediate plate. As pointed out above, if the rear wall of the vacuum pump is formed at least in part by a circumferential wall or shroud which radially extends from the rotor central portion, a plurality of openings are provided within the radial wall preferably in register with make-up air inlet ducts within the vacuum pump housing for permitting the air to enter the vacuum pump.

Axial clearances between the vacuum pump rotor and the vacuum pump chamber walls may also be adjusted by providing a rotor with rotor blades which are slightly tapered in radial direction or by providing a vacuum pump chamber wherein the side walls are slightly tapered in radial direction relative to the shaft to account for the slight bending or flexing of the shaft during operation of the vacuum pump.

The pump of the present invention may also be provided with means for introducing a sealing liquid to the clearances between the vacuum pump rotor and adjacent side walls for sealing the same and thus increasing the pumping action of the device. The sealing liquid may be introduced separately to one or both sides of the vacuum pump chamber so that it can flow into and seal the space or clearance between the pump rotor and adjacent side walls of the vacuum pump. The sealing liquid may also be fed to the spaces through a single conduit leading through the central portion of the vacuum pump rotor. A control valve for regulating the vacuum of the vacuum pump may also be directly attached at the end of the make-up air channel.

BRIEF DESCRIPTION OF THE DRAWINGS

The FIGURE represents is a vertical cross-sectional view of the centrifugal pump in accordance with the present invention.

DETAILED DESCRIPTION OF THE PRESENTLY PREFERRED EMBODIMENTS

The drawing shows a vertical cross-sectional view of the centrifugal pump for the pumping of gas containing media as, for example, medium consistency fiber suspensions in the pulp and paper industry. The centrifugal pump includes a housing 50 having an inlet channel 52 and a volute 54. The housing 50 is attached to the pump frame 56 having at one end thereof the bearing assembly (not shown) for supporting the pump shaft 58 at the end of which the centrifugal impeller 60 having a plurality of openings 62 extending through the back plate 64 thereof is mounted. The centrifugal impeller 60 is further provided with front vanes, i.e. working vanes 66, on the front side thereof and with back vanes 68 on the opposite side of the back plate 64. A rotor 87 having fluidizing blades 83 thereon may be mounted on the shaft 58 in front of impeller 60 for pumping fiber suspensions of medium or high consistency. The fluidizing blades may extend through the pump inlet 52 or be located only outside the inlet and within the pulp containing vessel. Located between the bearing unit and the centrifugal impeller 60 is the sealing assembly (not shown). Between the sealing assembly and the centrifugal impeller 60 there is mounted a vacuum pump 70 on the same shaft 58 as the centrifugal impeller 60. The vacuum pump 70 is separated from the volute 54, i.e. from the space housing the centrifugal impeller 60, by means of an intermediate plate 72 which also forms the head or the front wall 112 of the vacuum pump 70. In this embodiment plate 72 has a non-annular volume or opening 146 in the vicinity of the shaft 58 for permitting the gas to flow from the space behind the centrifugal impeller 60 to the vacuum pump 70. The volume or opening 146 preferably extends proximate to the shaft 58 or, depending on the design, proximate to the impeller extension sleeve 92, and communicates with centrifugal pump volute 54 through preferably annular opening 74 and with the vacuum pump through gas inlet port 94. The location of non-annular volume 146 is preferably chosen in accordance with or depending upon the pressure distribution in the volute 54. As is known, for example, the point of lowest pressure in the pump volute is just behind the pump outlet when viewed in the direction of rotation of the pump impeller. Locating the non-annular volume 146 at this position substantially decreases the danger of the fibers being drawn into the volume together with the gas. The volume may also be located at the point of highest pressure thereby requiring less vacuum for the removal of gas; or the volume may be positioned at any other location between the highest and lowest pressure as described.

An entry port 88 and conduit 71 is provided within the vacuum pump housing 78 for introducing a liquid, such as water, to the vacuum pump 70 to be used as a working liquid therein, i.e. to be used as the liquid ring which is continuously exhausted through outlet 80, 82 together with the air. On the other hand, a liquid, such as a water, may also be introduced into liquid inlet port 88, and through conduit 71 into opening 74, non-annular volume 146 and gas inlet port 94 to remove fibers therefrom which have entered these areas and may otherwise clog these passages and prevent the air from passing therethrough.

Another object of the present invention is to provide a liquid ring vacuum pump rotor 98 which has a central portion 102 which may be preferably conically tapered toward the gas discharge opening 80 as is shown in the drawing. The rotor is further provided at the end remote from the gas discharge opening 80 with a circumferential wall 168 which extends substantially radially outwardly from the rotor central portion 102 towards the annular wall 100 and forming a rotor shroud. This rotor shroud may thus act at least partially as the back wall of the vacuum pump. Utilizing the shroud greatly decreases the leakage problems caused by the clearance between the rotor and the pump side wall.

In the embodiment shown, the vacuum pump is used in connection with a centrifugal pump for the pumping of fiber suspensions, preferably of medium consistency, that is at about 6–15% solids consistency. In the centrifugal pump of the present invention the means for introducing air into the vacuum pump 70, namely, air inlet openings or channels 74, 146 and 94, as well as means for discharging the gas from the vacuum pump, namely, gas discharge opening 80 and ducts 81 and 82 are located on the same side of the vacuum pump in intermediate plate 72. Accordingly, the air which accumulates in front of impeller 60 passes through impeller openings 62 into annular opening 74 and from there through non-annular volume 146 and gas inlet port or channel 94 to the suction side of the vacuum pump 70 (the lower part of the vacuum pump in the figure). As the rotor continues to rotate, the medium, mostly gas present between the vanes of the rotor is compressed by the liquid ring and is expelled through the discharge port 80 and conduit 81 and 82. Preferably, but not necessarily the rotor central portion 102 has a radius which linearly decreases toward the gas discharge opening 80. In other words, rotor central portion 102 is preferably conically tapered toward the gas discharge opening so as to prevent the formation of air pockets around the rotor.

The vacuum pump is further provided with a make-up air inlet port 84 for permitting the introduction of control or make-up air into the pump chamber through the back wall 110. If the rotor central portion is provided with circumferential wall or shroud 168 as described above, the circumferential wall 168 is provided preferably with a plurality of openings 85 therein for permitting the air to pass through the circumferential wall 168 into the vacuum pump chamber 76. The make-up air inlet port 84 and the openings 85 in the circumferential wall 168 are preferably in register and, in radial direction, at or above the rotor central portion for easy access of air into the vacuum pump chamber. As mentioned, intermediate wall (72) may alternatively be provided with a make-up inlet port 84' allowing the introduction of air into one or both of the non-annular volume (146) and opening (94). In this embodiment, the rotor shroud used need not be provided with the openings (85) as described above but may be solid throughout.

It should be understood that the preferred embodiments and examples described herein are for illustrative purposes only and are not to be construed as limiting the scope of the present invention which is properly delineated only in the appended claims.

What is claimed is:

1. A centrifugal pump for pumping gas containing medium comprising:

a centrifugal pumping chamber (54);

a centrifugal impeller (60) rotatably mounted within said pumping chamber (54);

a liquid ring vacuum pump (70) having a vacuum pump chamber (76) adjacent said centrifugal pumping chamber and comprising a radially vaned vacuum pump rotor (96) mounted for rotation therein;

an intermediate plate (72) separating said pumping chamber from said vacuum pump; and a gas inlet port (94) and a gas discharge port (80) on the same axial side of said vacuum pump within said intermediate wall (72) for permitting entry into and discharge of said gas from said vacuum pump.

2. The centrifugal pump of claim 1, wherein said intermediate plate (72) additionally comprises a gas passageway (81) connected to said gas outlet port (80); and said vacuum pump further comprising a front wall (112) formed by said intermediate wall (72) and a back wall (110) spaced from and opposite said intermediate wall.

3. The centrifugal pump of claim 2, wherein said vacuum pump rotor is mounted between said intermediate plate (72) and said back wall (110) and further comprises a central portion (102) which is conically tapered towards said gas inlet port and gas discharge port.

4. The centrifugal pump of claim 1, additionally comprising a shaft (58) extending through said vacuum pump chamber (76) and intermediate plate (72); said impeller (60) and said vacuum pump rotor (98) being mounted on said shaft.

5. The centrifugal pump of claim 4, wherein said vacuum pump rotor additionally comprises a radial extension (168) at said rotor central portion (102) spaced from and opposite said gas inlet and gas discharge openings.

6. The centrifugal pump of claim 5, wherein said radial extension (168) forms the vacuum pump back wall.

7. The centrifugal pump of claim 5, wherein said vacuum pump additionally comprises a pump housing (78); a make-up air inlet duct (84) within said pump housing opposite said intermediate plate (72) and remote therefrom; and said radial extension (168) comprises a plurality of axial openings (85) therethrough for permitting said make-up air to enter said vacuum pump chamber (76).

8. The centrifugal pump of claim 5, additionally comprising a non-annular volume (146) within said intermediate plate (72), a liquid inlet duct leading to at least one of said non-annular volume (146) within said intermediate plate (72) and said gas inlet (94) into said vacuum pump.

9. The centrifugal pump of claim 1, additionally comprising a non-annular volume (146) within said intermediate plate (72) communicating with said vacuum pump chamber (76); a conduit (71) within said intermediate plate (72) connected to said non-annular volume (146) for introducing a liquid into at least one of said volume (146) and said vacuum pump chamber (76).

10. The centrifugal pump of claim 8, additionally comprising an opening (74) within said intermediate plate (72) and communicating with said pumping chamber (76) and said non-annular volume (146).

11. The centrifugal pump of claim 9, wherein said intermediate plate additionally comprises means (84') for introducing make-up air into at least one of said volume (146) and said vacuum pump chamber (76).

12. The centrifugal pump of claim 1, additionally comprising a rotor having fluidizing blades, said rotor being mounted in front of said impeller.

13. The centrifugal pump of claim 12, wherein said centrifugal pump additionally comprises a pump inlet and wherein said fluidizing blades are located outside said pump inlet.

14. The centrifugal pump of claim 1, wherein said intermediate plate additionally comprises means for introducing make-up air into said vacuum pump.

* * * * *